US008919548B2

(12) United States Patent
McGuire et al.

(10) Patent No.: US 8,919,548 B2
(45) Date of Patent: Dec. 30, 2014

(54) GOLF BAGS WITH RETENTION SYSTEM AND METHODS TO MANUFACTURE GOLF BAGS

(75) Inventors: Brian J. McGuire, Phoenix, AZ (US); Kim K. Chau, Phoenix, AZ (US); Ruben E. Whitten, Phoenix, AZ (US); Alex Cowan, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 506 days.

(21) Appl. No.: 12/961,254

(22) Filed: Dec. 6, 2010

(65) Prior Publication Data

US 2012/0055820 A1 Mar. 8, 2012

Related U.S. Application Data

(60) Provisional application No. 61/380,993, filed on Sep. 8, 2010.

(51) Int. Cl.
*A63B 55/00* (2006.01)
*A63B 55/04* (2006.01)

(52) U.S. Cl.
CPC ..... *A63B 55/045* (2013.01)
USPC ..... 206/315.7; 206/315.1; 206/315.25; 206/315.3; 206/315.5; 280/645; 280/47.26; 248/96; 248/95; 248/97

(58) Field of Classification Search
USPC ..... 206/315.1, 315.2, 315.3, 315.7; 248/96, 248/95, 97, 169; 280/645, 47.26
See application file for complete search history.

(56) References Cited

U.S. PATENT DOCUMENTS

| | | | | | |
|---|---|---|---|---|---|
| 1,790,092 | A | * | 1/1931 | William et al. | 248/96 |
| 1,880,351 | A | * | 10/1932 | McDonald | 248/96 |
| 2,282,842 | A | * | 5/1942 | Abell | 248/96 |
| 4,676,464 | A | | 6/1987 | Reimers | |
| 4,685,561 | A | | 8/1987 | Reimers | |
| 4,778,136 | A | * | 10/1988 | Reimers | 248/96 |
| 4,834,235 | A | * | 5/1989 | Solheim et al. | 206/315.7 |
| 5,156,366 | A | * | 10/1992 | Anderson | 248/96 |
| 5,339,951 | A | * | 8/1994 | Chen | 206/315.7 |
| 5,340,063 | A | * | 8/1994 | Hsieh | 248/96 |
| 5,353,003 | A | | 10/1994 | Maurer | |
| 5,356,003 | A | * | 10/1994 | Gretz et al. | 206/315.7 |
| 5,634,616 | A | | 6/1997 | Wang et al. | |
| 5,816,399 | A | * | 10/1998 | Rhee | 206/315.7 |
| 6,098,797 | A | * | 8/2000 | Han | 206/315.7 |

FOREIGN PATENT DOCUMENTS

| | | |
|---|---|---|
| GB | 2353481 | 2/2001 |

* cited by examiner

*Primary Examiner* — Fenn Mathew
*Assistant Examiner* — Cynthia Collado

(57) ABSTRACT

Embodiments of golf bags with an extensible bag stand having a retention system and methods to manufacture golf bags are generally described herein. Other embodiments of golf bags with an extensible bag stand having a retention system may be described and claimed.

5 Claims, 9 Drawing Sheets

GOLF BAGS WITH RETENTION SYSTEM AND METHODS TO MANUFACTURE GOLF BAGS

CROSS-REFERENCE TO RELATED APPLICATIONS

This is a non-provisional claiming benefit of U.S. Provisional Application No. 61/380,993 entitled "Golf Bags with Retention Mechanism and methods to Manufacture Golf Bags filed on Sep. 8, 2010, the contents of which are entirely incorporated by reference.

FIELD

The present disclosure is related to golf bags and methods to manufacture such golf bags, and in particular a carry golf bag with an extensible bag stand having a retention system.

BACKGROUND

Most golf bags may be in the form of a tubular fabric or leather container having a generally cylindrical configuration with a closed bottom end and an open top end through which golf clubs are inserted into and removed from the golf bag. Although golf bags are manufactured in a variety of sizes and materials so as to better suit various intended uses, golf bags are conventionally grouped into two basic classes. The first class of golf bags are relatively large and heavy, and therefore are not very well suited for carrying by the individual (e.g., cart bags), while the second class of golf club bags are generally smaller and lighter and are designed to be carried by the individual during play.

The second class of golf bags are usually referred to as "carry bags" which are carried by the individual using a carrying strap that may be used to lift and carry the golf bag. Many of these types of carry bags have an extensible bag stand devised for supporting the golf bag in a substantially upright position whenever the individual sets down the golf bag on a surface. A widely used and well known extensible golf bag stand has been devised for demountable attachment to the side of golf bags is disclosed in U.S. Pat. No. 4,834,236 which describes a golf bag stand having a pair of legs with one end pivotally attached to one portion of the golf bag and another end engaged to a retraction mechanism. The retraction mechanism is configured to operate with a toggle mechanism that causes the retraction mechanism to retract and collapse the pair of legs from a deployed position to a retracted position whenever the golf bag is lifted and carried by the individual. However, the retraction mechanism for such golf bags can become worn after repeated use and lose the ability to effectively collapse the legs to the retracted position. A worn retraction mechanism can also lose the ability to maintain the pair of legs in the retracted position whenever the golf bag is carried because one or both of the legs may droop due to the loss of tensile strength in the retraction mechanism that retains the pair of legs in the retracted position.

BRIEF DESCRIPTION OF THE DRAWINGS

Corresponding reference characters indicate corresponding elements among the view of the drawings. The headings used in the figures should not be interpreted to limit the scope of the claims.

DESCRIPTION OF EXAMPLES OF EMBODIMENTS

Golf bags designed to be carried by the individual usually have an extensible bag stand having legs devised for supporting the golf bag in a substantially upright position when the individual sets down the golf bag on a surface. The extensible bag stand may also include a retraction mechanism adapted to retract the legs into a retracted position when the golf bag is lifted off the surface and carried by the individual. However, repeated use of the extensible bag stand can cause the retraction mechanism to become worn over time and lose the ability to completely collapse the legs to the retracted position or fail to maintain the legs in the retracted position when the golf bag is carried by an individual.

As such, the golf bag with extensible bag stand having a retention system and method of manufacturing such a retention system as described herein improves such golf bags by automatically collapsing the pair of legs into the retracted position and maintaining the legs in the retracted position when the individual lifts up and carries the golf bag.

Figure 1:
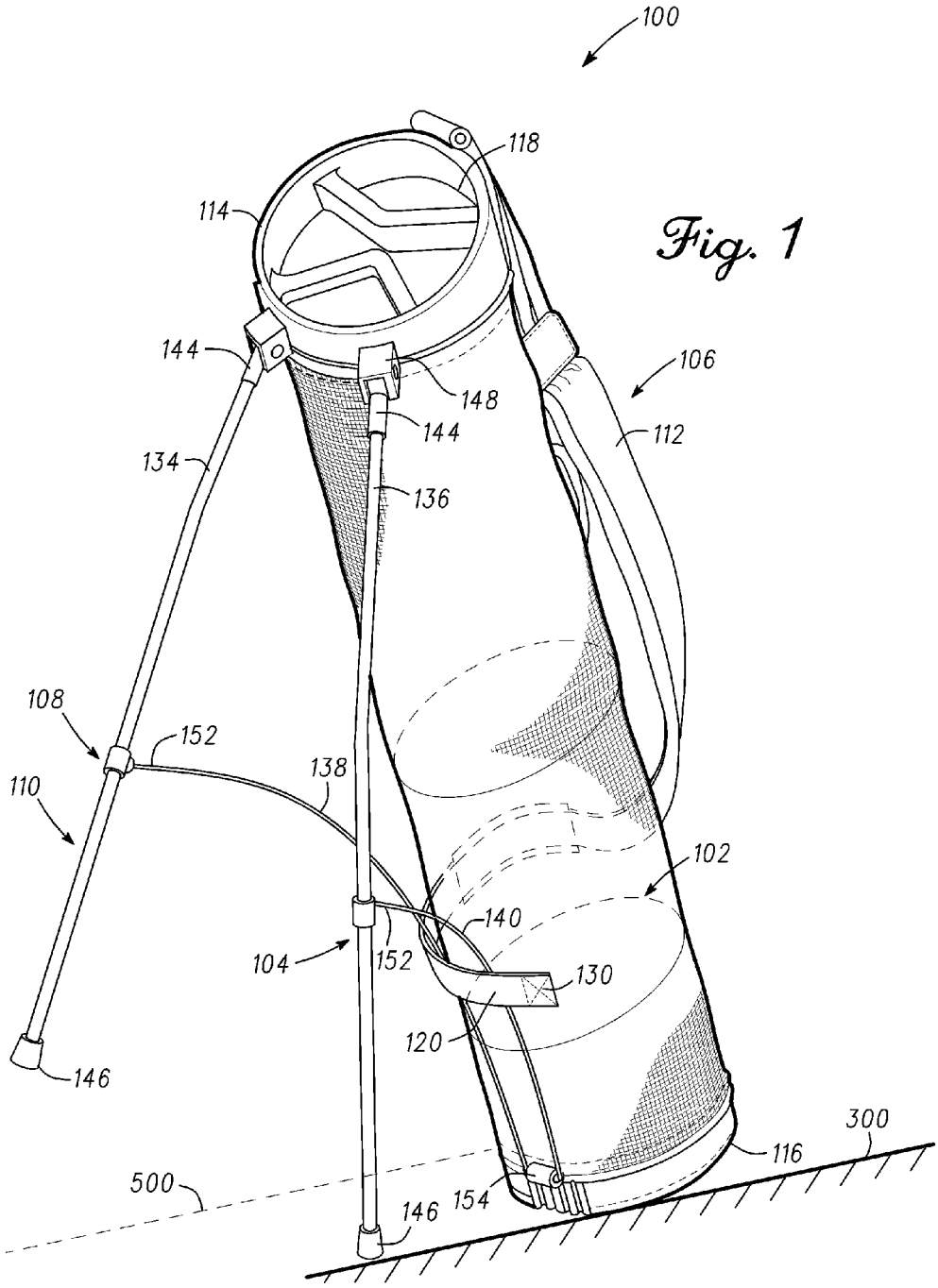
FIG. 1 is a simplified illustration of one embodiment of a golf bag having a retention system with an extensible bag stand in the deployed position.
Figure 2:
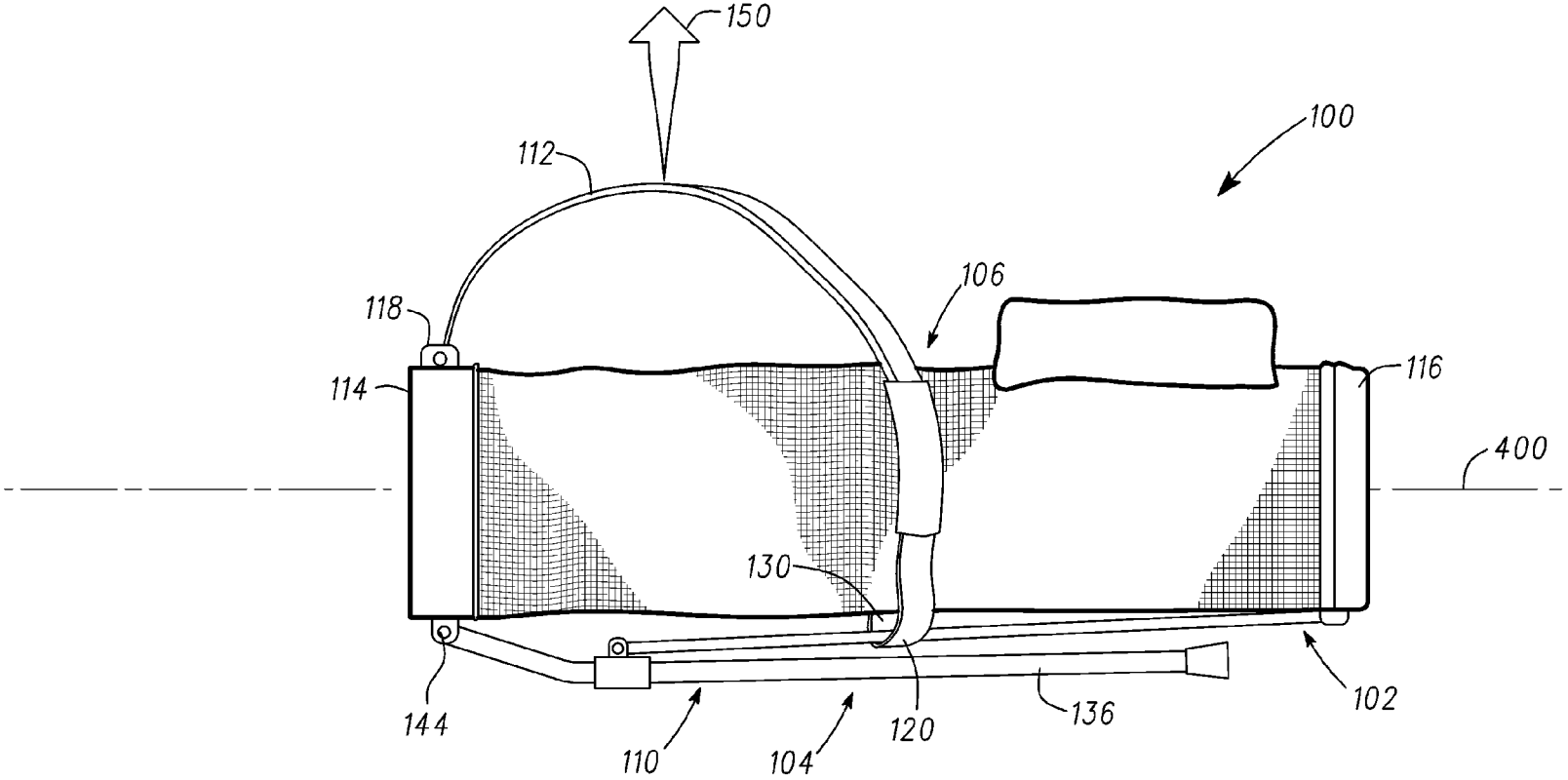
FIG. 2 is a simplified illustration showing the embodiment of the golf bag having the retention system of FIG. 1 with the extensible bag stand in the retracted position.
Figure 3:
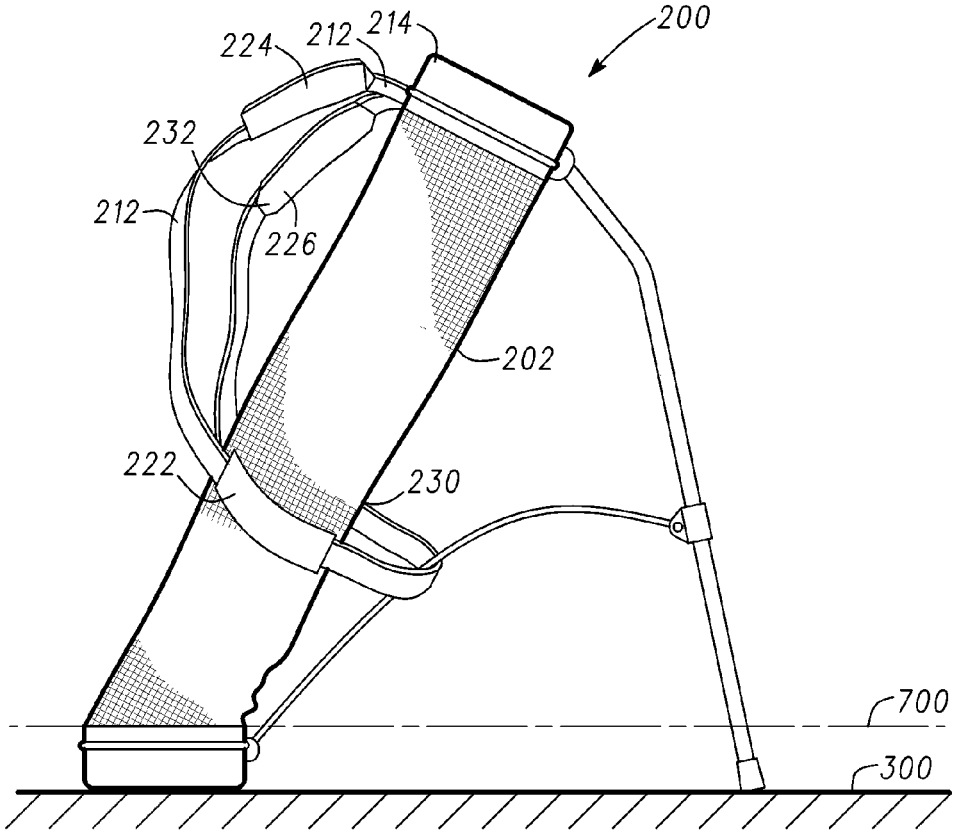
FIG. 3 is a simplified illustration of another embodiment of the golf bag having a retention system with the extensible bag stand in the deployed position.
Figure 4:
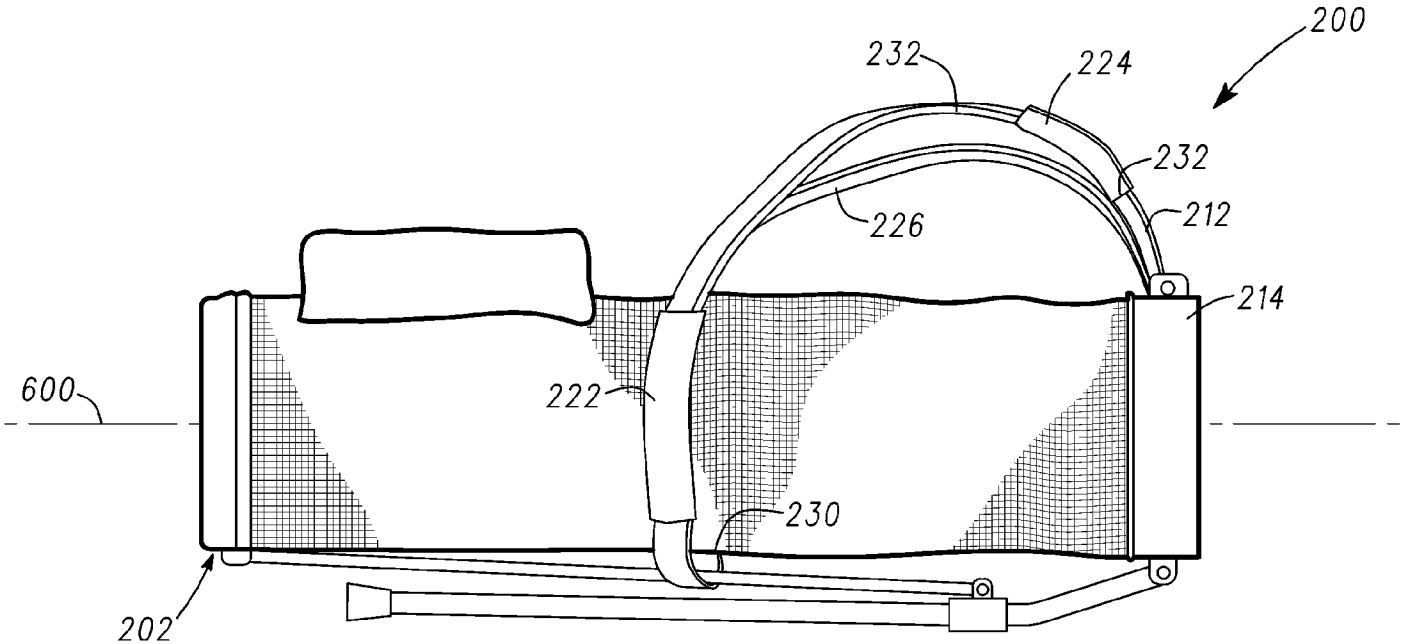
FIG. 4 is a simplified illustration showing the embodiment of the golf bag having the retention system of FIG. 3 with the extensible bag stand in the retracted position.
Figure 5:
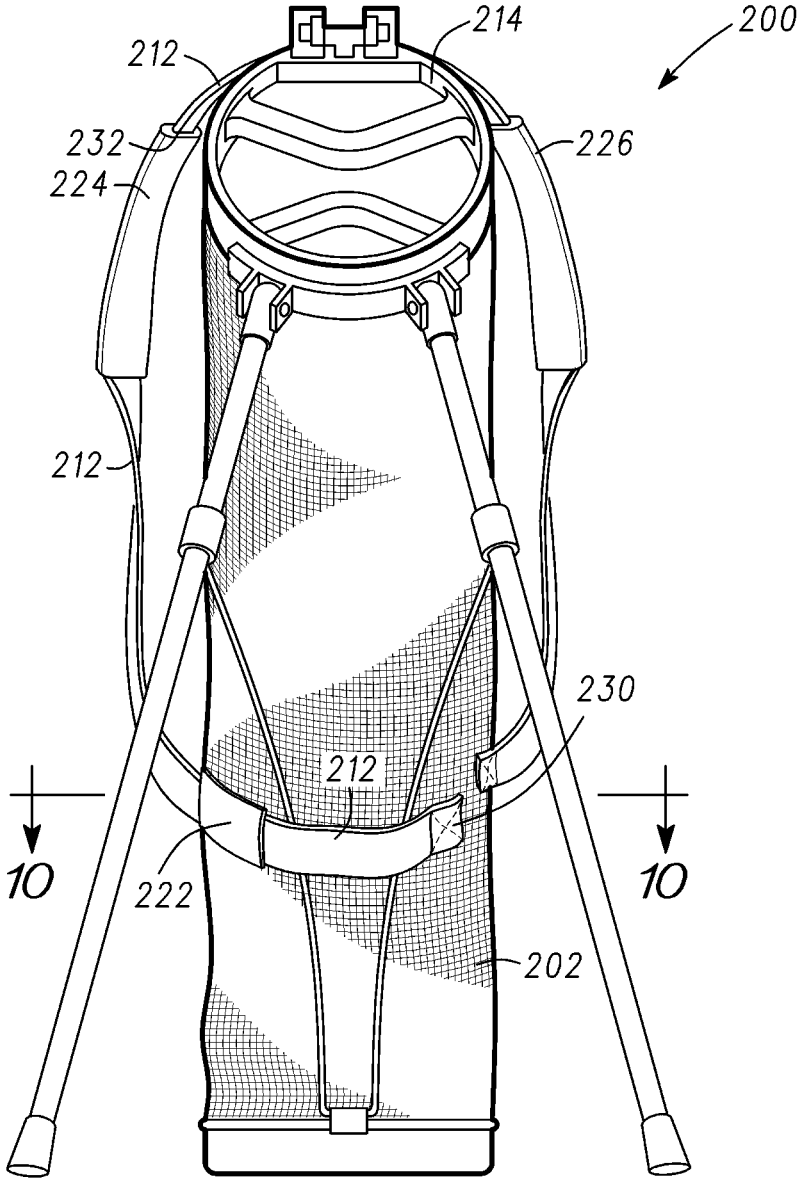
FIG. 5 is a front view showing the embodiment of the golf bag having the retention system of FIGS. 3 and 4 with the extensible bag stand in the deployed position.

Referring to the drawings, an embodiment of the golf bag is illustrated and generally indicated as 100 in FIGS. 1 and 2. In general, the golf bag 100 includes a generally tubular elongated body 102 defining an open top end 114 and a closed bottom end 116. As shown in FIG. 1, the tubular elongated body 102 includes an extensible bag stand 104 for supporting the tubular elongated body 102 in a substantially upright position when an individual sets down the golf bag on a surface 300. The extensible bag stand 104 includes a retraction mechanism 108 having an upper end 152 connected to a plurality of legs 110 and a lower end 154 connected to the tubular elongated body 102. Each of the legs 110 includes one end 144 pivotally attached to the tubular elongated body 102 for positioning the legs 110 between a deployed position and a retracted position. In addition, a retention system 106 includes a biasing portion 112 having a first end 118 attached to a first portion of the tubular elongated body 102 and a second end 120 attached to a second portion of the tubular elongated body 102. The biasing portion 112 may be arranged such that the retraction mechanism 108 is positioned between the tubular elongated body 102 and the biasing portion 112. As shown in FIG. 2, the biasing portion 112 retracts the retraction mechanism 106 when an external force 150 is applied to the biasing portion 112 such that the biasing portion 112 positions and maintains the legs 110 in the retracted position. The biasing portion 112 may be a band, a strap, a cord, or a rope.

As used herein the term "deployed position" shall mean the position of the legs 110 being substantially deployed outwardly from the tubular elongated body 102 when the individual sets the golf bag 100 down such that the legs 110 contact the surface 300, whereas the term "retracted position" shall mean the position of the legs 110 being substantially retracted inwardly towards the tubular elongated body 102 such that the legs 110 no longer contact the surface 300 as the individual lifts up the golf bag 100.

The retraction mechanism 108 for the extensible bag stand 104 may be a spring wire 108 made of a resilient metallic material that bias the legs 110 outwardly when the tubular elongated body 102 is placed in the deployed position and then retracts the legs 110 inwardly to the retracted position whenever the tubular elongated body 102 is lifted of the surface 300. The spring wire 108 may be a single wire arrangement or a plurality of wires. Alternatively, the spring wire 108 may be made from any other resilient material, such as a plastic or a metallic composite, capable of repeatedly applying a bias to the legs 110 in either the deployed position or the retracted position by the extensible bag stand 104.

As shown in FIG. 1, one example of the spring wire 108 may be first and second wires 138 and 140 that engage a respective pair of legs 134 and 136. Specifically, the first and second wires 138 and 140 may each have a first leg end 152 that engages a respective leg 134 and 136 and a second leg end 154 that is operatively engaged to the tubular elongated body 102. In particular, each second leg 154 may be operatively engaged to a toggle mechanism (not shown) that forms a part of the golf bag 100 for causing either the deployed position or the retracted position of legs 110 by the extensible bag stand 104.

As further shown, the pair of legs 134 and 136 each define one end 146 adapted to support the tubular elongated body 102 in a substantially upright position on the surface 300 as well as another end 144 that may be pivotally engaged to a bracket 148 attached proximate the open top end 114 of the tubular elongated body 102. The pivotal engagement of each end 144 to the bracket 148 may be a pin and socket arrangement which allows movement of the legs 110 along a two-dimensional plane or a ball and socket arrangement that allows movement of the legs 110 along a three-dimensional plane. In one embodiment, the structure and operation of the extensible bag stand 104 may be the extensible bag stand disclosed in U.S. Pat. No. 4,834,235, which is incorporated by reference in its entirety. However, the apparatus, articles of manufacture, and methods described herein are not limited in this regard.

In one arrangement, the second end 120 of the biasing portion 112 may be engaged to the tubular elongated body 102 such that the biasing portion 112 establishes a fixed point 130 relative to the tubular elongated body 102. When an individual applies an external force 150, such as by lifting the tubular elongated body 102 off the surface 300, the weight of the golf bag 100 creates a tension in the biasing portion 112 that causes the biasing portion 112 to slide relative to the fixed point 130 and retract the spring wire 108. When the golf bag 100 is carried by the individual such that the longitudinal axis 400 (FIG. 2) is substantially parallel to plane 500 (FIG. 1), the force of gravity acting on the tubular elongated body 102 creates a constant tension on the biasing portion 112 that maintains the spring wire 108 in a substantially retracted position until the tension is released by setting the tubular elongated body 102 on surface 300. In this arrangement, the retention system 106 requires the weight of the tubular elongated body 102 as a force, the individual as a pivot point, and the biasing portion 112 as a tensioning means to provide a much greater force to retract the spring wire 108 to the retracted position than would otherwise be available if the retention system 106 was absent. Setting down the tubular elongated body 102 on surface 300 causes the biasing portion 112 to loosen as the external force 150 is no longer being applied and permit the spring wire 108 and legs 110 to assume a deployed position.

Referring to FIGS. 3, 4, 5 and 10 another embodiment the golf bag, designated 200, is substantially similar to golf bag 100. In particular, a channel 222 may be provided along the tubular elongated body 202 that is configured to receive the biasing portion 212 and acts to guide the biasing portion 212 relative to tubular elongated body 202 when the tubular elongated body 202 is being lifted or carried by the individual. The channel 222 also acts as a means of transferring the tension applied to the biasing portion 212 through the channel 222 when an external force 150 is applied to the biasing portion 212. Alternatively, the golf bag 200 may include a ring, hook and/or buckle arrangement, either internal or external to the tubular elongated body 202 that also guides the biasing portion 212 in similar fashion as channel 222. The channel 222 may be made of woven materials, webbing, or a hard plastic material and either sewn or otherwise attached internally or externally relative to the tubular elongated body 202. It is contemplated that the channel 222 may also be provided with the tubular elongated body 102 of golf bag 100 to provide the same guiding function as described above.

The golf bag 200 may also include a carrying strap 224 for permitting an individual to lift and carry the tubular elongated body 202. The carrying strap 224 defines a conduit 232 that is engaged to the biasing portion 212 and permits the individual to apply the external force 150 to the biasing portion 212 by lifting the carrying strap 224 off the surface 300 such that the longitudinal axis 600 of tubular elongated body 202 is substantially parallel to the plane 700 of surface 300. The biasing portion 212 may have a first end attached proximate the open top end 214, while a second end of the biasing portion 212 is attached to a fixed point 230 in similar fashion as described above. Alternatively, the golf bag 200 may include a second carrying strap 226 having a first end that is also attached proximate the open top end 214, while a second end of the carrying strap 226 is fixedly attached along the lower portion of the tubular elongated body 202. In one embodiment, the second carrying strap 226 is not engaged to the biasing portion 212 such that only the first carrying strap 224 is engaged to the biasing portion 212 and functions to apply any tension through the biasing portion 212.

Figure 6:
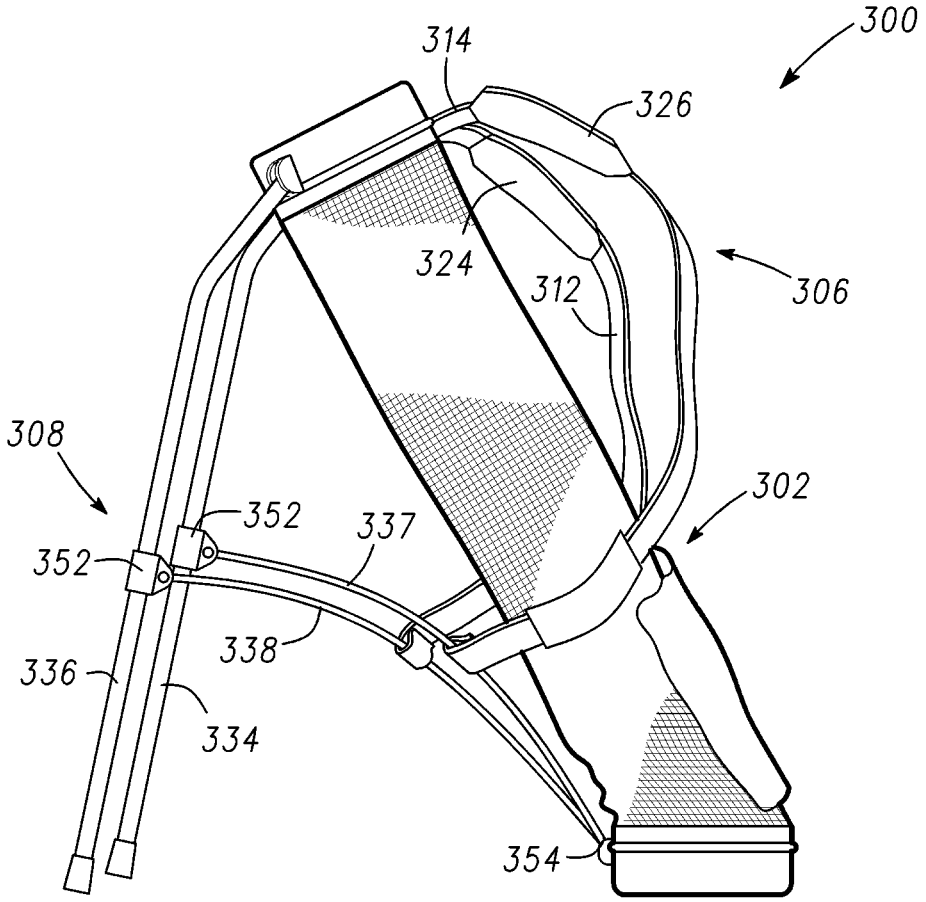
FIG. 6 is a simplified illustration of yet another embodiment of the golf bag having a retention system with the extensible bag stand in the deployed position.
Figure 7:
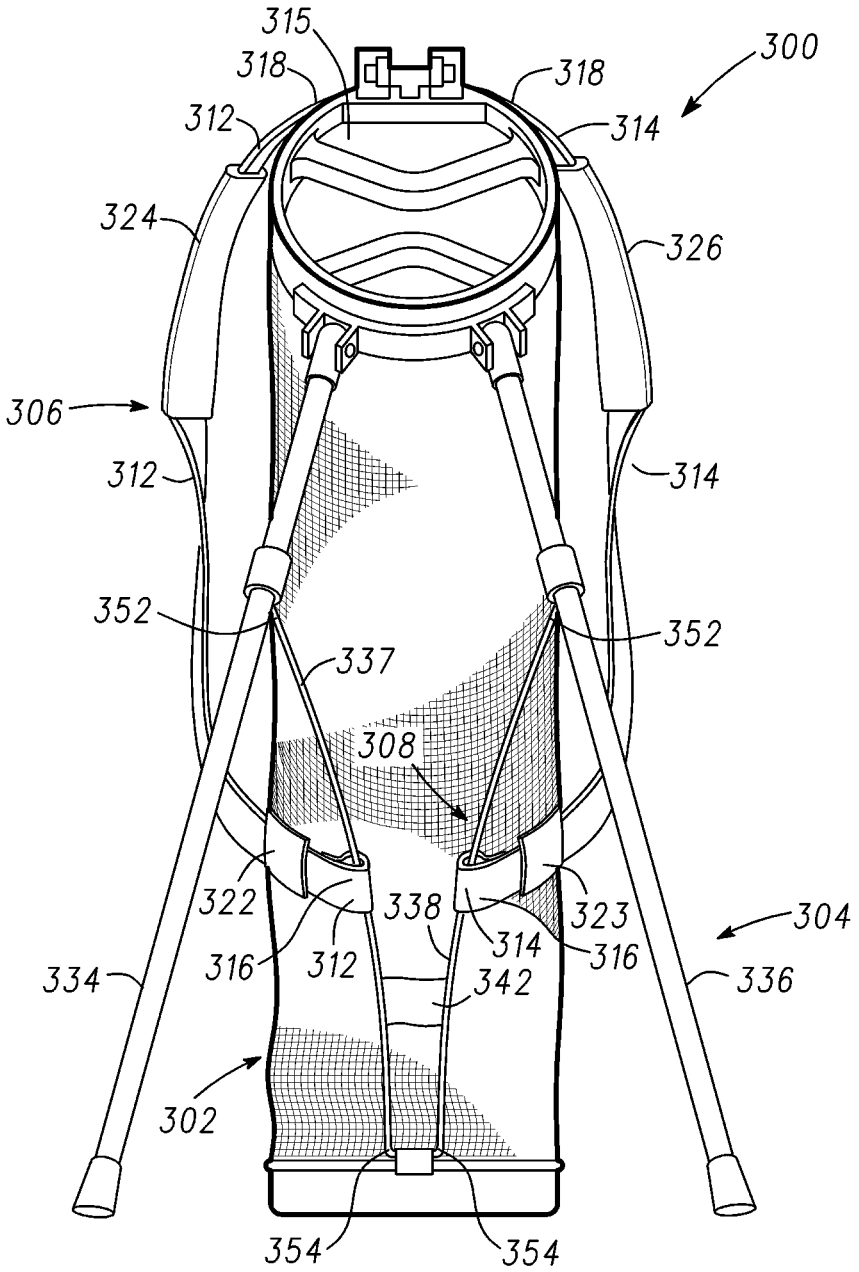
FIG. 7 is a front view showing the embodiment of the golf bag having the retention system of FIG. 6 with the extensible bag stand in the deployed position.

Referring to FIGS. 6 and 7, another embodiment of the golf bag, designated 300, is similar to golf bags 200 and 300 with the exception of the arrangement and operation of biasing portion relative to the extensible bag stand 304 as shall be described below. The retention system 306 may include a first biasing portion 312 and a second biasing portion 314 with each portion 312 and 314 having a first end 316 engaged or looped around a first wire 337 and a second wire 338, respectively, of retraction mechanism 308. In addition, the first biasing portion 312 and second biasing portion 314 each have a second end 318 attached to the tubular elongated body 302 proximate the open top end 315. A first carrying strap 324 may be engaged to the first biasing portion 312 and a second strap 326 may be engaged to the second biasing portion 314 such that applying the external force 150 (FIG. 2) to the carrying straps 324 and 326 generates a tension in each biasing portion 312 and 314 and causes the retraction mechanism 308 to retract and collapse the first and second legs 334 and 336 into the retracted position from the deployed position. In one embodiment, the first and second wires 337 and 338 may each have a first leg end 352 that engages a respective leg 334 and 336 and a second leg end 354 that is operatively engaged to the tubular elongated body 302 for positioning the first and second legs 334 and 336 between a deployed position and a retracted position. In addition, the golf bag 300 may include first and second channels 322 and 323 that are adapted to receive and guide the first and second biasing portions 312 and 314, respectively. In addition, a connector 342 may engage the first wire 336 to the second wire 338.

In reference to the embodiments 100, 200 and 300 of golf bag, the retention systems of these embodiments, and in particular the biasing portions 112, 212 and 312 do not engage the plurality of legs 110, 210 and 310, but only engage the retraction mechanism 108, 208 and 308, for example the spring wire, during operation.

Figure 8:
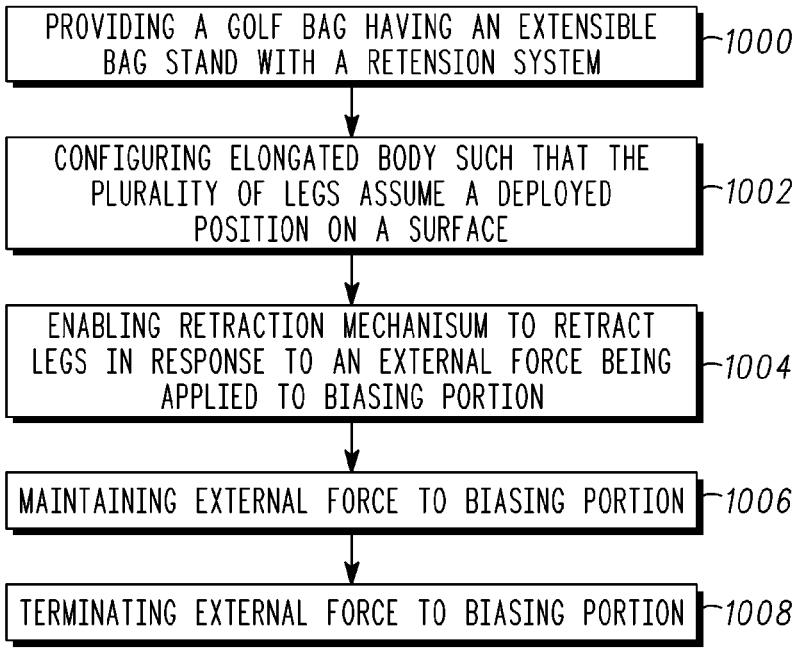
FIG. 8 is a flow chart illustrating one method of using the golf bag with the retention system.

Referring to FIG. 8, a flow chart illustrates one method for lifting or using the golf bag of embodiments 100, 200 or 300 from a deployed position to a retracted position. At block 1000, a golf bag 100, 200, or 300 is provided having an extensible bag stand 104, 204 or 304 with a retention system 106, 206 or 306. At block 1002, the tubular elongated body 102, 202 or 302 is configured such that the legs 110, 210 or 310 assume on a surface 300 the deployed position. At block 1004, enabling the external force 150 to be applied to one or more biasing portions 112, 212, 214, 312 and/or 314 such that the one or more biasing portions 112, 212, 214, 312 and/or 314 cause the retraction mechanism 108, 208 or 308 to retract the one or more of legs 110, 210 or 310. The external force 150 may be maintained to the one or more biasing portions 112, 212, 214, 312 and/or 314 as recited in block 1006, thereby preventing the plurality of legs 110, 210 or 310 from moving from the retracted position. Finally, at block 1008, the external force 150 applied to the one or more biasing portions 112, 212, 214, 312 and/or 314 may be terminated such that the one or more legs 110, 210 or 310 are placed in the deployed position.

Figure 9:
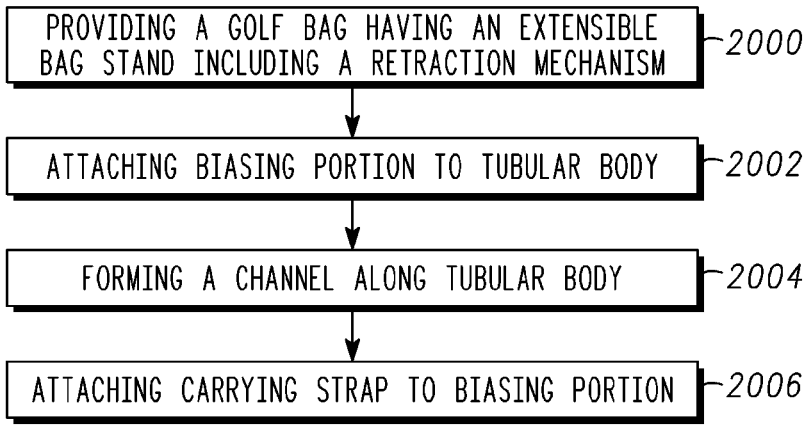
FIG. 9 is a flow chart illustrating one method to manufacture the golf bag with the retention system.
Figure 10:
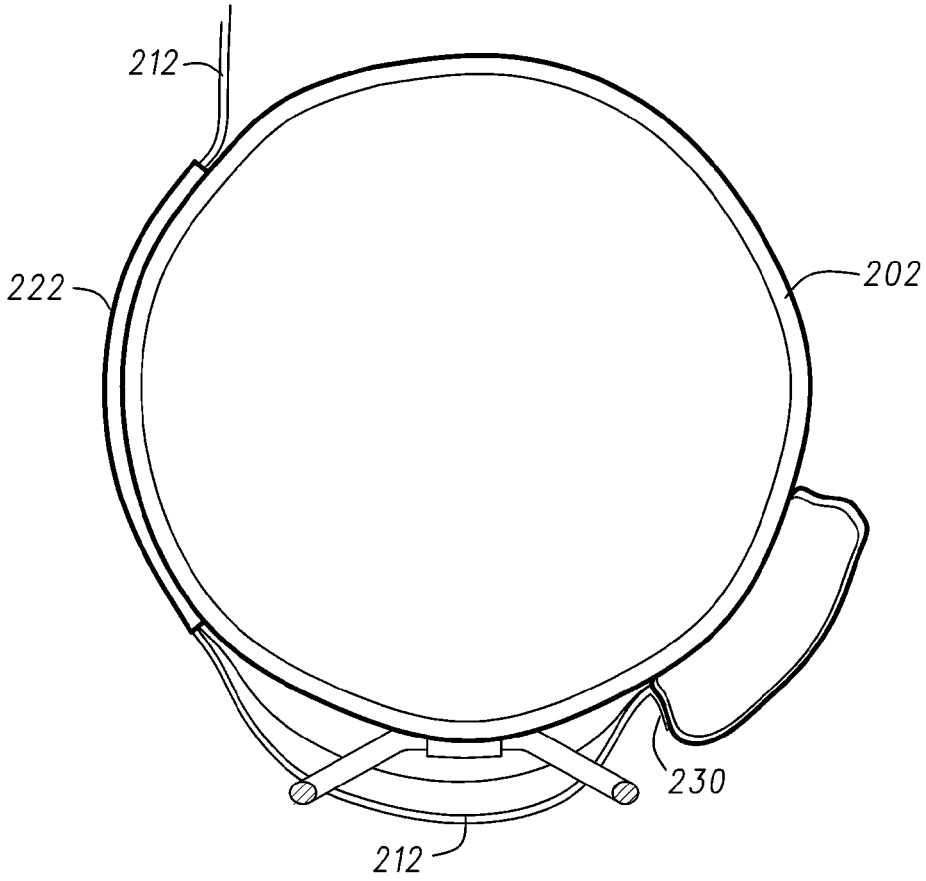
FIG. 10 is a cross-sectional view taken along line 10-10 of FIG. 5 showing a channel of the retention system.

Referring to FIG. 9, a flow chart illustrating one method for manufacturing a golf bag 100 is shown. At block 2000, a golf bags 100, 200 and 300 are provided having the extensible bag stand 104, 204 and 304 with the a retraction mechanism 106, 206 and 306. At block 2002, one or more biasing portions 112, 212, and/or 312 are attached to the tubular elongated body 202 and 302. One or more channels 222 are then formed along the tubular elongated body 202 and 302 at block 2004. At block 2006, carrying straps 224, 226, 324, and 326 are attached to respective biasing portions 212 and 312.

While a particular order of actions is illustrated in FIGS. 8 and 9, these actions may be performed in other temporal sequences. For example, two or more actions may be performed in either FIG. 8 or FIG. 9 may be performed sequentially, concurrently, or simultaneously. Although FIGS. 8 and 9 depict a particular number of blocks, the processes of FIGS. 8 and 9 may not perform one or more blocks.

While the above examples may describe and the figures may depict golf bags with two legs, the apparatus, methods, and articles of manufacture described herein may be applicable to golf bags with a single leg. Alternatively, the apparatus, methods, and articles of manufacture described herein may also be applicable to golf bags with three or more legs. However, the apparatus, methods, and articles of manufacture described herein are not limited in this regard.

Furthermore, the golf bag having an extensible bag stand with a retention system and methods to manufacture discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of the golf bag having an extensible bag stand with a retention system and methods to manufacture golf bags, and may disclose alternative embodiments of golf bags and methods of manufacture. It is intended that the scope of golf bags having an extensible bag stand with a retention system and methods of manufacture shall be defined by the appended claims All elements claimed in any particular claim are essential to golf bags having an extensible bag stand with a retention system and methods of manufacture in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf bag comprising:

an elongated body having an open top end and a closed bottom end;

an extensible bag stand including a retraction mechanism having a first end connected to the elongated body and a second end attached to a plurality of legs for applying a biasing force to the plurality of legs for retraction and deployment of the plurality of legs, each of the plurality of legs having one end pivotally attached to the elongated body for positioning the plurality of legs between a deployed position and a retracted position by the retraction mechanism, and a retention system including a plurality of elongated biasing portions, each of the plurality of elongated biasing portions having a first biasing end attached to the elongated body and a second biasing end attached to a respective portion of the retraction mechanism, wherein the plurality of elongated biasing portions is configured to retract the respective portion of the retraction mechanism in response to an external force is applied to each of the plurality of biasing portions such that the plurality of legs retracts from the deployed position to the retracted position when the retraction mechanism is retracted by the plurality of elongated biasing portions.

2. The golf bag of claim 1, wherein the retraction mechanism comprises a spring wire having a plurality of wires with each of the plurality of wires being attached to a respective one of the plurality of elongated biasing portions.

3. The golf bag of claim 1, wherein the retraction mechanism is a spring wire comprising a plurality of wires with each of the plurality of wires being attached to a respective one of the plurality of elongated biasing portions, and wherein the plurality of wires comprises a pair of wires and the plurality of elongated biasing portions comprises a pair of elongated biasing portions, and wherein each of the pair of wires is attached to a respective one of the pair of elongated biasing portions.

4. The golf bag of claim 1, further comprising a channel defined along the elongated body, wherein the plurality of elongated biasing portions slides within the channel when the external force is applied to the plurality of elongated biasing portions.

5. The golf bag of claim 1, wherein the second leg end of at least one of the plurality of legs are in contact with a surface when in the deployed position and wherein the external force being applied to the plurality of elongated biasing portions causes the elongated body to be lifted off the surface and cause the retraction mechanism to retract the plurality of legs to the retracted position.

* * * * *